United States Patent [19]

Immell et al.

[11] 4,089,005

[45] May 9, 1978

[54] DUAL FREQUENCY ANTENNA

[75] Inventors: Raymond G. Immell, Mesa; Bill H. Sasser, Phoenix, both of Ariz.

[73] Assignee: Motorola, Inc., Schaumburg, Ill.

[21] Appl. No.: 758,247

[22] Filed: Jan. 10, 1977

[51] Int. Cl.[2] ..... H01Q 9/00

[52] U.S. Cl. ..... 343/845; 343/830

[58] Field of Search ..... 343/701, 828–831, 343/845, 729

[56] References Cited

U.S. PATENT DOCUMENTS

| | | | |
|---|---|---|---|
| 3,343,089 | 9/1967 | Murphy et al. | 343/701 |
| 3,623,161 | 11/1971 | Fujimoto et al. | 343/829 |
| 3,838,429 | 9/1974 | Reggia | 343/830 |

*Primary Examiner*—Alfred E. Smith
*Assistant Examiner*—David K. Moore
*Attorney, Agent, or Firm*—Eugene A. Parsons

[57] ABSTRACT

First and second elements mounted in parallel spaced apart relation with one end shorted to form a quarter-wave transmission line at a base frequency and a half-wave transmission line at an even harmonic thereof, with the spacing being $\lambda/8$ at the base frequency and $\lambda/4$ at the harmonic and a feedline being connected between the elements and positioned so the impedance of the antenna matches the impedance of the feedline at the base frequency and the diameter of the feedline being adjusted so the impedance of the antenna matches the impedance of the feedline at the harmonic frequency.

6 Claims, 2 Drawing Figures

DUAL FREQUENCY ANTENNA

BACKGROUND OF THE INVENTION

1. Field of the Invention

In many applications it is desirable to receive on a first frequency and transmit on a second frequency or to receive on two different frequencies or transmit on two different frequencies. In many instances, because of size limitations, cost or complexity, it is desirable to use the same antenna for both frequencies.

Specifically, in transducers for automatic positioning systems, radio object locating systems and in certain remotely controlled systems it is desirable to receive a signal at a first frequency and transmit the same or an answering signal at a second frequency. For example, the system may receive a base frequency and transmit a second harmonic of the base frequency.

2. Description of the Prior Art

In prior art dual frequency antennas, such as that disclosed in U.S. Pat. No. 2,479,227, entitled "Dual Frequency Antenna", issued on Aug. 16, 1949, to E. N. Gilbert, the antennna is extremely large and complicated.

A second type of dual frequency antenna is disclosed in U.S. Pat. No. 3,691,563, entitled "Dual Band Stripline Antenna", issued to Phillip L. Shelton on Sept. 12, 1972. This antenna is small compared to the above described structure but is relatively complicated to construct, compared to the present device.

In U.S. Pat. No. 3,343,089, entitled "Quarterwave Low Profile Antenna Tuned to Halfwave Resonance by Stub; also Including a Transistor Driving Stage", issued to E. R. Murphy, et al, on Sept. 19, 1967, and assigned to the same assignee as the present invention, a transmission line antenna is disclosed. However, this antenna is not a dual frequency antenna.

SUMMARY OF THE INVENTION

The present invention pertains to a dual frequency antenna including first and second spaced apart electrically conductive elements with electrically conductive means connected between said elements so as to provide an electrical short therebetween and positioned for forming a transmission line which is open circuited at one end and short circuited at the other end with the electrical characteristics of a quarter wavelength transmission line at one frequency and a half wavelength Transmission line at the other frequency, the antenna further including feed means connected between the first and second elements and spaced from the electrically conductive means so as to provide a predetermined impedance to the feed means and the spacing of the first and second elements being sufficient to cause said antenna to appear to said feed means as a quarter wavelength antenna at the harmonic frequency.

It is an object of the present invention to provide an improved dual frequency antenna.

It is a further object of the present invention to provide an improved dual frequency antenna which is extremely simple and inexpensive to construct.

It is a further object of the present invention to provide an antenna which is tuned to operate at a base frequency and a selected even harmonic thereof and which provides the correct characteristic impedance to the driving means at both frequencies.

These and other objects of this invention will become apparent to those skilled in the art upon consideration of the accompanying specification, claims and drawings.

BRIEF DESCRIPTION OF THE DRAWINGS

Referring to the drawings, wherein like characters indicate like parts throughout the Figures.

DESCRIPTION OF THE PREFERRED EMBODIMENT

Figure 1:
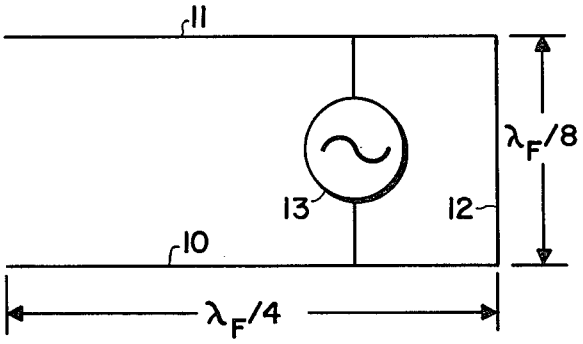
FIG. 1 is a schematic view of a dual frequency antenna embodying the present invention and FIG. 2 is a perspective view of the antenna illustrated schematically in FIG. 1.
Figure 2:
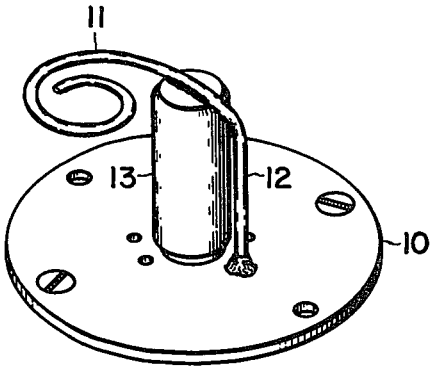

In the Figures the numeral 10 designates a plate having a flat upper surface, which plate is formed of electrically conductive material and may form a portion of the base structure of the device on which the antenna is mounted, or may be a portion of the base structure, etc. The plate 10 forms a first electrically conductive element of a transmission line, the second element of which is a wire 11 mounted parallel with and in spaced relationship to the plate 10. The wire 11 is spirally shaped in the present embodiment to conserve space, but it should be understood that the specific configuration is not crucial to the invention and many other configurations might be devised by those skilled in the art or which are dictated by specific applications. In the present embodiment the wire 11 is affixed to the plate 10 and electrically connected thereto by an extension 12 of the wire which is bent perpendicular to the wire element 11 and fixedly and electrically attached to the plate 10. The extension 12 is a short circuit at one end of the transmission line formed by the plate 10 and wire 11, and the other end of the transmission line is open. It should be understood that many other electrically conductive means might be utilized in place of the extension 12 to short the one end of the transmission line and to mount the wire 11 in spaced relation from the plate 10, but the extension 12 is utilized in this embodiment because of its simplicity.

In the present embodiment the dual frequency antenna is designed to operate at a base frequency and a second harmonic thereof. The length of the wire 11 is such that the transmission line appears as a quarter wavelength stub open at one end and shorted at the other, to the base frequency and, consequently, a one-half wavelength stub to the second harmonic. While the terms quarter wavelength and half wavelength are utilized throughout this specification, it should be understood that the electrical characteristics of a quarter wavelength or one-half wavelength transmission line are being referred to and transmission lines with lengths which are multiples of the quarter and one-half wavelengths, having the same characteristics, (e.g. quarter wavelength and one wavelength might be utilized if the fourth harmonic of the base frequency is desired, or three-quarter and one and one-half wavelengths might be utilized for the second harmonic in place of the quarter and one-half wavelengths, etc.).

A feedline 13 is connected between the plate 10 and the wire 11 at a point along the transmission line having a characteristic impedance approximately equal to the characteristic impedance of the means driving the antenna. The characteristics impedance of the transmission line varies from zero at the short circuit to a maximum at the open end thereof. For example, the impedance of the transmission line where the feedline 13 is connected in the Figures is approximately 50 ohms. At the base frequency, *f*, the transmission line transforms the low current at the driving point to a high current in the short circuit, which causes the structure to radiate. Operation at the base frequency, *f*, requires only that the transmission line be a quarter wavelength long and places no restrictions on the height or impedance of the transmission line.

To operate at the second harmonic, *2f*, the spacing between the wire 11 and the plate 10 is adjusted to be an eighth wavelength at the base frequency, *f*, which is a quarter wavelength at the second harmonic *2f*. At the second harmonic the input impedance is determined by the diameter of the feedline 13 and its spacing from the short circuit, extension 12. Since the spacing between the feedline 13 and the extension 12 is a requirement to match the antenna at the base frequency, *f*, it is necessary to adjust the diameter of the feedline to match the antenna at the second harmonic, *2f*.

In the operation of the antenna at the second harmonic, the transmission line becomes a one-half wavelength with an open circuit at the end, which reflects the open circuit to the feedpoint and does not effect the input impedance. Even though a standing wave is formed on the transmission line at the base frequency and the second harmonic, the transmission line does not radiate. At the base frequency the short circuit, extension 12, radiates and at the second harmonic both the feedline 13 and the short circuit radiate in phase. Because of the small spacing between the feedline 13 and the short circuit, extension 12, at both frequencies the radiation pattern is that of a monopole antenna.

While we have shown and described a specific embodiment of this invention, further modifications and improvements will occur to those skilled in the art. We desire it to be understood, therefore, that this invention is not limited to the particular form shown and we intend in the appended claims to cover all modifications which do not depart from the spirit and scope of this invention.

What is claimed is:

1. An antenna constructed to operate at a base frequency and an even harmonic frequency, said antenna comprising:

(a) first and second, spaced apart, electrically conductive elements;

(b) electrically conductive means connected between said first and second elements, providing an electrical short therebetween and positioned for forming a transmission line which is open circuited at one end and short circuited at the other end with the electrical characteristics of a quarter wavelength transmission line at the base frequency and a half wavelength transmission line at the harmonic frequency;

(c) antenna feed means connected between said first and second elements and spaced from said electrically conductive means for providing a predetermined impedance to said feed means; and (d) the spacing of said first and second elements being sufficient to provide said antenna with the electrical characteristics of a monopole quarter wavelength antenna at the harmonic frequency.

2. An antenna as claimed in claim 1 wherein the spacing between the antenna feed means and the conductive means provides an impedance to the feed means substantially equal to the characteristic impedance of the feed means at the base frequency.

3. An antenna as claimed in claim 2 wherein the antenna feed means includes a feedline connected to the first and second elements and having a diameter such that the impedance of the antenna substantially matches the feedline at the harmonic frequency.

4. An antenna as claimed in claim 1 wherein the first and second elements are a base member having a flat surface and a wire positioned parallel to the flat surface, respectively.

5. An antenna as claimed in claim 4 wherein the harmonic is the second harmonic, the length of the first and second elements between the conductive means and the open end is one-quarter wavelength at the base frequency and the spacing between the first and second element is one-eighth wavelength at the base frequency.

6. An antenna as claimed in claim 4 wherein the electrically conductive means and the second element are formed from the wire affixed at one end to the base member and extending outwardly therefrom to form the conductive means.

* * * * *